United States Patent [19]

Burbach

[11] 4,389,767

[45] Jun. 28, 1983

[54] METHOD OF MANUFACTURING PULVERIZER ROLLS

[75] Inventor: Henry E. Burbach, Avon, Conn.

[73] Assignee: Combustion Engineering, Inc., Windsor, Conn.

[21] Appl. No.: 214,847

[22] Filed: Dec. 10, 1980

[51] Int. Cl.[3] ..... B22D 11/126; B02C 15/04

[52] U.S. Cl. ..... 29/527.1; 29/527.3; 29/402.18; 29/402.07; 241/117

[58] Field of Search ..... 29/527.1, 527.2, 527.3, 29/530, 402.05, 402.06, 402.07, 402.08, 402.11, 402.12, 402.13, 402.18, 402.19; 241/117

[56] References Cited

U.S. PATENT DOCUMENTS 3,409,966 11/1968 Hilbish ..... 29/527.3

3,541,674 11/1970 Sable ..... 29/527.3

*Primary Examiner*—Francis S. Husar

*Assistant Examiner*—V. K. Rising

*Attorney, Agent, or Firm*—Arthur E. Fournier, Jr.

[57] ABSTRACT

A method particularly suited for manufacturing a pulverizer, i.e., grinding, roll (18) of the type that is designed to be embodied in a bowl mill (10) so as to be operative therein for purposes of effecting the pulverization of a material such as coal through the coaction of the pulverizer roll (18) with another surface with which the bowl mill (10) is provided for this purpose. The subject method includes the steps of forming from a material that is characterized by its ease of machinability a body (50) having the general configuration of a roll, providing through the center of the body (50) a suitably dimensioned through passage (54) capable of having a support member positioned therewithin in mounted relation thereto, shaping the outer surface (58) of the body (50) in accordance with the predicted wear characteristics that the pulverizer roll (18) is expected to experience based on the nature of the use to which the pulverizer roll (18) is intended to be put such that the contour thereof replicates that of a worn pulverizer roll, and applying a substantially uniform layer of a material characterized by its wear-resistant qualities to the outer surface of the body (50).

8 Claims, 4 Drawing Figures

METHOD OF MANUFACTURING PULVERIZER ROLLS

BACKGROUND OF THE INVENTION

This invention relates to rolls, and more specifically, to a method of manufacturing pulverizer rolls of the type that are intended to be used in bowl mills for purposes of effecting the pulverization therein of material such as, for example, coal.

An essential component of any steam generation system of the type, which utilizes pulverized coal as a fuel, is the apparatus in which the coal is pulverized so as to render it suitable for such usage. Although the prior art is known to have employed various types of apparatus for purposes of accomplishing coal pulverization, one form of apparatus in particular, which has frequently been used for this purpose, is that commonly referred to as a bowl mill by those in the industry. The bowl mill obtains its name principally from the fact that the pulverization, i.e., grinding, of the coal that takes place therewithin occurs on a grinding surface, which in configuration somewhat resembles a bowl.

By way of illustration, reference may be had to U.S. Pat. No. 3,465,971, which is assigned to the same assignee as the present invention, for a showing of a prior art form of bowl mill. This patent contains a teaching of both the nature of the construction and the mode of operation of a bowl mill that is suitable for use for purposes of effecting the pulverization of the coal that is used to fuel a coal-fired steam generator. As taught by this patent, the essential components of such a bowl mill are a body portion, i.e., housing, within which a grinding table is mounted for rotation, a plurality of grinding rolls that are supported in equally spaced relation one to another in a manner so as to coact with the grinding table such that the coal disposed on the surface of the grinding table is capable of being ground, i.e., pulverized, by the rolls, coal supply means for feeding to the surface of the grinding table the coal that is to be pulverized in the bowl mill, and air supply means for providing to the interior of the body portion the air that is required for the operation of the bowl mill.

In order to satisfy the demands of a coal-fired steam generation system of conventional construction for pulverized coal, a plurality of bowl mills of the type shown in the aforereferenced patent are commonly required to be employed. Further in this regard, it is noted that the individual capacity of each of these bowl mills may range up to a capacity of one hundred tons of pulverized coal per hour. In addition to possessing the capability of operating at this maximum capacity, these bowl mills must also have the ability to operate at less than full capacity, i.e., at some percentage thereof, e.g., 25%, 50%, 75%, etc. Lastly, these bowl mills must be capable of use with a variety of types of coal that possess different grinding characteristics.

In accord with the mode of construction illustrated in the aforereferenced patent, the grinding rolls are each designed to be mounted on a shaft-like member whereby the grinding rolls are capable of movement relative to the surface of the grinding table. Accordingly, in order to effect the assembly of the grinding roll with the aforesaid shaft-like member, the former preferably has a through passage provided through the center thereof. This through passage enables the shaft-like member to be positioned therewithin in mounted relation thereto. Therefore, in order to facilitate the task of providing the grinding roll with such a through passage, it is desirable that the grinding roll be made of a material that is characterized by its easy machinability, i.e., a relatively soft material such as gray iron.

In contradistinction to the desirability of making the grinding roll from a relatively soft material, there also exists a requirement that at least the external surface of the grinding roll be of a material characterized by good wear-resistant qualities. The reason for this is that in the course of effecting the pulverization of material with these grinding rolls, the latter are of necessity subjected to a harsh abrasive action by virtue of the nature of the material being pulverized as well as by virtue of the manner in which the pulverization takes place. The result, therefore, is that the grinding rolls are susceptible to being rendered unusable because of excessive wear in a relatively short period of time, i.e., the rolls are found to have a relatively short operating life. Obviously, such a result is to be avoided, if possible. In this context, it should be noted that the wear which grinding rolls employed in bowl mills actually experience is influenced principally by the grinding characteristics of the material being pulverized as well as by the productive output of the bowl mill, i.e., the volume of material that is being pulverized within the bowl mill in a given period of time.

When the external surface of the pulverizer, i.e., grinding, roll becomes sufficiently worn to preclude any further use thereof for purposes of effecting the pulverization of material therewith, the remaining portions of the roll are normally still functional. That is, but for its worn external surface, the grinding roll would still be capable of being used. Thus, from the standpoint of achieving economies of manufacture, it would be desirable, if possible, to effect a resurfacing of the external surface of the grinding roll such that the latter might once again be utilized for purposes of pulverizing material rather than to have to replace the worn grinding roll with a totally new grinding roll. In this regard, one would normally expect that the cost of reconditioning, i.e., resurfacing the external surface of a worn grinding roll would be significantly less costly than manufacturing a totally new grinding roll.

Apart from the relative cost of resurfacing the external surface of a worn grinding roll vis-a-vis that of manufacturing a totally new grinding roll, there is also the matter of the operating life achievable with a resurfaced worn grinding roll as contrasted to that obtainable with a new grinding roll. That is, in order to be economically feasible, it is desirable that the operating life of a resurfaced worn grinding roll be approximately equivalent to or greater than that which one would expect from a new grinding roll. Namely, any savings achieved from utilizing a resurfaced worn grinding roll as opposed to employing a new grinding roll should not be dissipated by virtue of the fact that the operating life of the former is such that several resurfacings thereof would be required in order to achieve an operating life with the worn grinding roll which approximates that obtainable from the use of a totally new grinding roll. In summary, if in the interest of obtaining comparable operating lives, multiple resurfacings of the worn grinding roll would be required, the cost thereof would probably equal or exceed the cost of manufacturing a totally new grinding roll whereby the advantages accruing from reusing a worn grinding roll vis-a-vis replacing the latter with a new grinding roll would not be realized.

It has been known in the prior art to resurface a worn grinding roll. Moreover, the results obtainable therefrom have proven to be generally satisfactory. More commonly, the resurfacing has taken the form of providing the external surface of the worn grinding roll with a suitably dimensioned layer of weld metal. In view of the prior art's experience with the resurfacing of a worn grinding roll, attempts have been made to provide the external surface of new grinding rolls with a hard facing. Unfortunately, such attempts when applied to new grinding rolls have not met with a great deal of success heretodate. The motivation behind these attempts resides largely in the desire to effectively extend the operating life of new grinding rolls. A major reason why the attainment of a longer operating life for new grinding rolls is sought is that it would enable one to extend the point in time at which it becomes necessary to shut down the bowl mill for purposes of enabling the removal therefrom of the worn grinding roll, and the replacement thereof with an unworn grinding roll. In this regard, mention is once again made of the fact that a plurality of bowl mills are commonly employed to provide the required amount of pulverized coal to a coal-fired steam generator, and that each of these bowl mills normally embodies three grinding rolls that are each susceptible to having to be removed and replaced as they become worn. Also, there is the matter of the time and effort and the cost associated therewith that needs to be expended in the course of effecting such removal and replacement of a worn grinding roll. Obviously, therefore, it one were able to reduce the frequency with which grinding rolls become sufficiently worn as to require replacement, cost savings could be realized in terms of the time and effort required to be expended to effect such replacement. A need has, thus, been shown to exist in the prior art for a new and improved method of manufacturing pulverizer rolls which would be capable of producing pulverizer rolls that would be characterized by the fact that the latter possessed a significantly longer operating life than that commonly found to be obtainable from a newly manufactured pulverizer roll that has been manufactured in accordance with heretofore known prior art methods.

It is, therefore, an object of the present invention to provide a new and improved method of manufacturing a pulverizer roll.

It is another object of the present invention to provide such a method whereby the pulverizer roll manufactured in accordance therewith is primarily suitable for embodiment in a bowl mill for use therein to effect the pulverization of a material such as coal.

It is still another object of the present invention to provide such a method wherein the pulverizer roll manufactured in accordance therewith is characterized by its relatively long operating life.

A further object of the present invention is to provide such a method wherein the pulverizer roll manufactured in accordance therewith achieves its relatively long operating life by virtue of having a hard facing applied in a novel manner to the external surface of the pulverizer roll.

A still further object of the present invention is to provide such a method wherein the pulverizer roll manufactured in accordance therewith achieves its relatively long operating life by virtue of having a layer of weld metal applied in a novel manner to the external surface of the pulverizer roll.

Yet another object of the present invention is to provide such a method wherein the pulverizer roll manufactured in accordance therewith is characterized by the fact that the external surface thereof is shaped in accordance with the predicted wear characteristics that the pulverizer roll is expected to experience based on the nature of the use to which the pulverizer roll is intended to be put such that the contour thereof replicates that of a worn pulverizer roll.

Yet still another object of the present invention is to provide such a method which is relatively easy to employ, and which enables economies of manufacture to be realized through the use thereof.

SUMMARY OF THE INVENTION

In accordance with the present invention there is provided a method of manufacturing pulverizer rolls of the type designed to be used in a bowl mill to effect the pulverization of material such as coal therewithin. The subject method includes the steps of forming from an easily machinable material a body having the general configuration of a roll, forming a through passage through the center of the body, shaping the external surface of the body in accordance with the predicted wear characteristcs which it is expected that the body will experience based on the nature of the use to which the body is to be put, and applying to the external surface of the body a layer of material having good wear-resistant qualities.

DESCRIPTION OF THE PREFERRED EMBODIMENT

Figure 1:
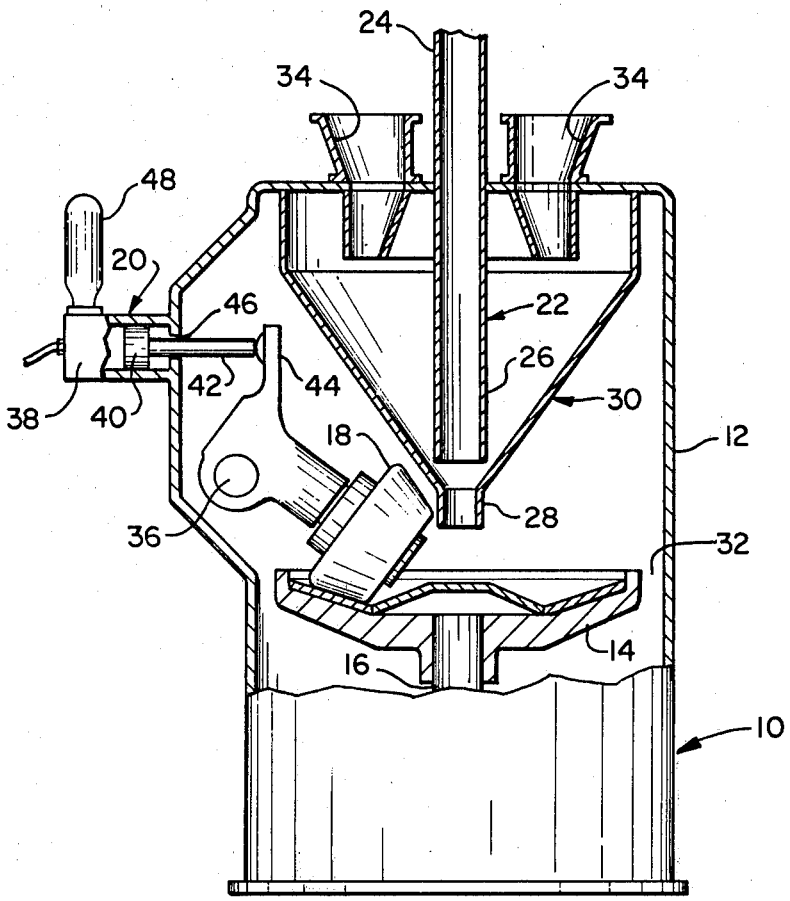
FIG. 1 is a side elevational view partly in section and with some parts broken away of a bowl mill embodying pulverizer rolls manufactured in accordance with the method of the present invention.

Referring now to the drawing, and more particularly to FIG. 1 thereof, there is depicted therein a pulverizing bowl mill, generally designated by reference numeral 10. Inasmuch as the nature of the construction and the mode of operation of pulverizing bowl mills per se are well-known to those skilled in the art, it is not deemed necessary, therefore, to set forth herein a detailed description of the pulverizing bowl mill 10 illustrated in FIG. 1. Rather, it is deemed sufficient for purposes of obtaining an understanding of a pulverizing bowl mill 10, that is capable of being equipped with pulverizer rolls manufactured in accordance with the method of the present invention, that there be presented herein merely a generalized description of the nature of the construction and the mode of operation of the components of the pulverizing bowl mill 10. For a more detailed description of the nature of the construction and the mode of operation of the components of the pulverizing bowl mill 10, which are not described in depth herein, one may have reference to the prior art, e.g., U.S. Pat. No. 3,465,971, which issued Sept. 9, 1969 to J. F. Dalenberg et al., and/or U.S. Pat. No. 4,002,299, which issued Jan. 11, 1977 to C. J. Skalka.

Referring further to FIG. 1 of the drawing, the pulverizing bowl mill 10 as illustrated therein includes a substantially closed separator body 12. A grinding table 14 is mounted on a shaft 16, which in turn is operatively connected to a suitable drive mechanism (not shown) so as to be capable of being rotatably driven thereby. With the aforesaid components arranged within the separator body 12 in the manner depicted in FIG. 1 of the drawing, the grinding table 14 is designed to be driven in a clockwise direction.

Continuing with a description of the pulverizing bowl mill 10, a plurality of pulverizer, i.e., grinding, rolls 18, preferably three in number in accord with conventional practice, are suitably supported within the interior of the separator body 12 so as to be spaced equidistantly one from another around the circumference of the latter. The method by which each of the grinding rolls 18 is manufactured comprises the subject matter that forms the essence of the present invention. A description of the method of the present invention will be found set forth hereinafter. However, note is first made here of the fact that in the interest of maintaining clarity of illustration only one grinding roll 18 has been depicted in FIG. 1. With further regard to the grinding rolls 18, each of the latter as best understood with reference to FIG. 1 of the drawing is preferably supported on a suitable shaft (not shown) for rotation relative thereto. In addition, the grinding rolls 18 are also each suitably supported in a manner yet to be described for movement relative to the upper surface, as viewed with reference to FIG. 1, of the grinding table 14. To this end, each of the grinding rolls 18 has a hydraulic means, generally designated in FIG. 1 by reference numeral 20, cooperatively associated therewith. Each of the hydraulic means 20 is operative, as will be described more fully hereinafter, to establish a hydraulic loading on the grinding roll 18 associated therewith whereby the latter roll 18 is made to exert the requisite degree of force on the coal that is disposed on the grinding table 14 for purposes of accomplishing the desired pulverization of this coal.

The material, e.g., coal, that is to be pulverized in the bowl mill 10 is fed thereto by means of any suitable conventional form of feed means. By way of exemplification in this regard, one such feed means that may be employed for this purpose is a belt feeder means (not shown). Upon being discharged from the feed means (not shown), the coal enters the bowl mill 10 by means of a coal supply means, generally designated by reference numeral 22, with which the separator body 12 is suitably provided. In accordance with the embodiment of the pulverizing bowl mill 10 illustrated in FIG. 1, the coal supply means 22 includes a suitably dimensioned duct 24 having one end thereof which extends outwardly of the separator body 12 and preferably terminates in a funnel-like member (not shown). The latter member (not shown) is suitably shaped so as to facilitate the collection of the coal particles entering the bowl mill 10, and the guiding thereafter of these coal particles into the duct 24. The other end 26 of the duct 24 of the coal supply means 22 is operative to effect the discharge of the coal onto the surface of the grinding table 14. To this end, as shown in FIG. 1 of the drawing, the duct end 26 preferably is suitably supported within the separator body 12 through the use of any suitable form of conventional support means (not shown) such that the duct end 26 is coaxially aligned with the shaft 16 that supports the grinding table 14 for rotation, and is located in spaced relation to a suitable outlet 28 provided in the classifier, generally designated by reference numeral 30, through which the coal flows in the course of being fed onto the surface of the grinding table 14.

In accord with the mode of operation of pulverizing bowl mills that embody the form of construction depicted in FIG. 1, a gas such as air is utilized to effect the conveyance of the coal from the grinding table 14 through the interior of the separator body 12 for discharge from the pulverizing bowl mill 10. The air that is used in this regard enters the separator body 12 through a suitable opening (not shown) formed therein for this purpose. From the aforesaid opening (not shown) in the separator body 12 the air flows to a multiplicity of annular spaces 32 suitably formed between the circumference of the grinding table 14 and the inner wall surface of the separator body 12. The air upon exiting from the annular spaces 32 is deflected over the grinding table 14 by means of suitably positioned deflector means (not shown). One such form of deflector means (not shown), which is suitable for use for this purpose in the bowl mill 10 of FIG. 1, comprises the subject matter of copending patent application, Ser. No. 41,155, which was filed on May 21, 1979, now U.S. Pat. No. 4,234,132, and which is assigned to the same assignee as the present application.

While the air is flowing along the path described above, the coal which is disposed on the surface of the grinding table 14 is being pulverized by the action of the grinding rolls 18. As the coal becomes pulverized, the particles are thrown outwardly by centrifugal force away from the center of the grinding table 14. Upon reaching the region of the circumference of the grinding table 14, the coal particles are picked up by the air exiting from the annular spaces 32 and are carried along therewith. The combined flow of air and coal particles is thereafter captured by the deflector means (not shown), which has been referred to previously hereinabove. The effect of this is to cause the combined flow of this air and coal particles to be deflected over the grinding table 14. This necessitates a change in direction in the path of flow of this combined stream of air and coal particles. In the course of effecting this change of direction, the heaviest coal particles, because they have more inertia, become separated from the air stream, and fall back onto the surface of the grinding table 14 whereupon they undergo further pulverization. The lighter coal particles, on the other hand, because they have less inertia continue to be carried along in the air stream.

After leaving the influence of the aforesaid deflector means (not shown), the combined stream of air and coal particles that remains flows to the classifier 30 to which mention has previously been had hereinbefore. The classifier 30 in accord with conventional practice and in a manner which is well-known to those skilled in this art, operates to effect a further sorting of the coal particles that remain in the air stream. Namely, those particles of pulverized coal, which are of the desired particle size, pass through the classifier 30 and along with the air are discharged therefrom and thereby from the bowl mill 10 through the outlets 34 with which the latter is provided for this purpose. On the other hand, those coal particles, which in size are larger than desired, are returned to the surface of the grinding table 14 whereupon they undergo further pulverization. Thereafter, these coal particles are subject to a repeat of the process described above. That is, the particles are thrown outwardly of the grinding table 14, are picked up by the air exiting from the annular spaces 32, are carried along with the air to the deflector means (not shown), are deflected back over the grinding table 14 by the deflector means (not shown), the heavier particles drop back onto the grinding table 14, the lighter particles are carried along to the classifier 30, those particles which are of the proper size pass through the classifier 30 and exit from the bowl mill 10 through the outlets 34.

With further regard to the matter of the pulverizing action to which the coal disposed on the upper surface of the grinding table 14, as viewed with reference to FIG. 1, is subjected by the grinding rolls 18, the amount of force that must be exerted on the latter in order to effect the desired degree of pulverization of the coal will vary depending on a number of factors. For example, one important consideration in this regard is the nature of the coal itself. That is, the amount of force required to pulverize the coal will be a function of the grindability of the coal to be pulverized, i.e., the grinding characteristics of the latter. Another important factor in determining the amount of force that the grinding rolls 18 must exert to accomplish the desired degree of pulverization of the coal is the depth to which the coal is disposed on the grinding table 14, which in turn is a function of the output rate at which the bowl mill 10 is being operated.

As best understood with reference to FIG. 1 of the drawing, the amount of grinding force which the grinding rolls 18 apply to the coal on the grinding table 14 is a function of the amount of force with which the grinding rolls 18 are biased into engagement with the coal on the table 14. In accord with the nature of the construction shown in FIG. 1, the grinding roll 18 depicted therein, which is suitably mounted for rotation on a shaft (not shown), is suitably supported so as to be pivotable about the pivot pin 36 into and out of engagement with the coal that is disposed on the grinding table 14. Although only one grinding roll 18 is shown in FIG. 1 and although this discussion is directed to this one grinding roll 18 it is to be understood that as has been mentioned previously hereinbefore the bowl mill 10 is normally provided with three such grinding rolls 18. Therefore, this discussion is intended to be equally applicable to each of the three such grinding rolls 18.

Continuing with the matter of the force exerted by the grinding roll 18, in accord with the nature of the construction illustrated in FIG. 1, the grinding roll 18 is designed to be biased hydraulically into and out of engagement with the coal that is on the grinding table 14. More specifically, to this end the hydraulic means 20 is cooperatively associated with the grinding roll 18. As shown in FIG. 1, the hydraulic means 20 includes a cylinder 38 suitably mounted to the exterior wall surface of the separator body 12. Within the cylinder 38, a piston 40 is suitably supported for movement therewithin. Attached to the piston 40 is a piston rod 42 of sufficient length so as to extend into the interior of the separator body 12 whereupon the free end of the piston rod 42 engages an upstanding member 44 that comprises a portion of the support means for the grinding roll 18. A suitable opening 46 is formed in the separator body 14 to enable the piston rod 42 to project into the interior of the latter. In a manner well-known to those skilled in the art of hydraulics, the cylinder 38 is filled with a suitable hydraulic fluid, such that a hydraulic pressure is applied by the fluid to the faces of the piston 40. The hydraulic fluid which fills the cylinder 38 is provided thereto from a suitable source thereof (not shown).

Accordingly, the extent to which the free end of the piston rod 42 projects into the interior of the separator body 12 for engagement with the member 44 is a function of the difference in hydraulic pressure, which is supplied to the faces of the piston 40. In turn, the extent to which the free end of the piston rod 42 extends into the interior of the separator body 12 determines the extent to which the grinding roll 18 is hydraulically biased into engagement with the coal on the grinding table 14, and concomitantly the amount of grinding force being applied to the coal by the grinding roll 18. That is, the piston rod 42 is fixedly attached to one face of the piston 40 such that as the piston 40 is moved in response to the difference in hydraulic pressure being applied to the faces of the piston 40, the piston rod 42 moves along therewith. It is to be understood in this connection that the opening 46 provided in the separator body 12 through which the piston rod 42 passes is equipped with suitable sealing means (not shown) operative to prevent the leakage through the opening 46 of hydraulic fluid from the cylinder 38 to the interior of the body 12.

By way of exemplification, the more the free end of the piston rod 42 extends into the interior of the separator body 12, the more it will cause the member 44 to move in a clockwise direction, as viewed with reference to FIG. 1, about the pivot pin 36, and thereby have the effect of increasing the amount of grinding force that the grinding roll 18 exerts on the coal that is on the grinding table 14. Conversely, the less the free end of the piston 42 projects into the interior of the separator body 12 the less clockwise movement there will be of the member 44 about the pivot pin 36, and thus the less grinding force the roll 18 will exert on the coal that is resting on the table 14.

Lastly, in accord with the preferred form of construction, the hydraulic means 20 is provided with an accumulator 48. The function of the latter is to obviate any potentially damaging consequences that might otherwise flow from the occurrence of some form of transient operating condition. For example, should some foreign object be introduced into the bowl mill 10 along with the coal to be pulverized, and should this foreign object become exposed on the grinding table 14, the effect of the grinding roll 18 engaging this foreign object would be to raise the roll 18 away from the table 14, i.e., would be to cause the roll 18 to move in a counterclockwise direction as viewed with reference to FIG. 1, about the pivot pin 36. As a consequence thereof, the member 44 would be made to apply a force against the free end of the piston rod 42 tending to cause the piston 40 to move in a direction away from the wall surface of the separator body 12. Further, as the piston 40 moves in this manner, the hydraulic fluid located in that portion of the cylinder 38 towards which the piston 40 is moving would tend, absent the presence of the accumulator 48 to resist the movement of the piston 40. This could result in damage being incurred by the various components that are operatively associated with the grinding roll 18.

Accordingly, the function of the accumulator 48 is to permit hydraulic fluid to flow thereinto as the fluid is being forced from the cylinder 38 by the advancing piston 40. However, as soon as the grinding roll 18 passes over the foreign object, the grinding roll 18 is once again restored to its normal position, i.e., nontransient condition. This occurs by virtue of the flow from the accumulator 48 into the cylinder 38 of the hydraulic fluid which had been made to flow into the former from the latter, because of the counterclockwise movement, as viewed with reference to FIG. 1, of the grinding roll 18 about the pivot pin 36 caused by the raising of the roll 18 as the latter engaged and passed over the foreign object located on the table 14.

Figure 2:
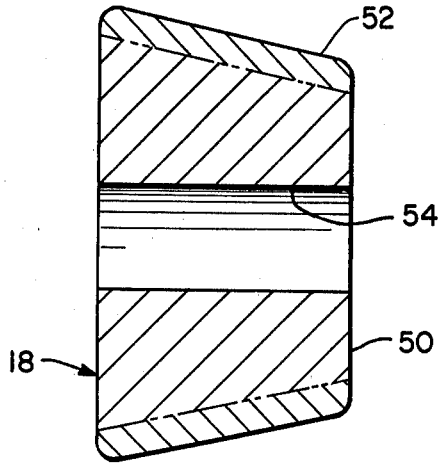
FIG. 2 is a sectional view on an enlarged scale of a pulverizer roll manufactured in accordance with the method of the present invention.
Figure 3:
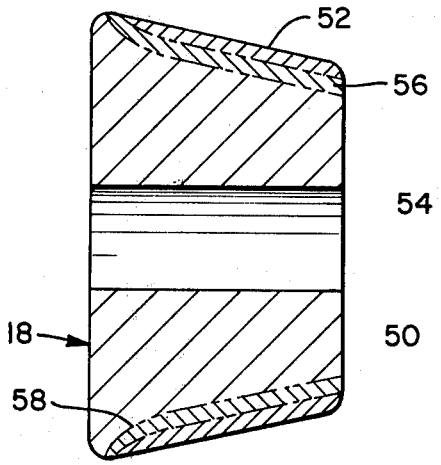
FIG. 3 is a sectional view on an enlarged scale of a pulverizer roll manufactured in accordance with the method of the present invention, illustrating the application of a layer of weld metal to the external surface of the pulverizer roll.
Figure 4:
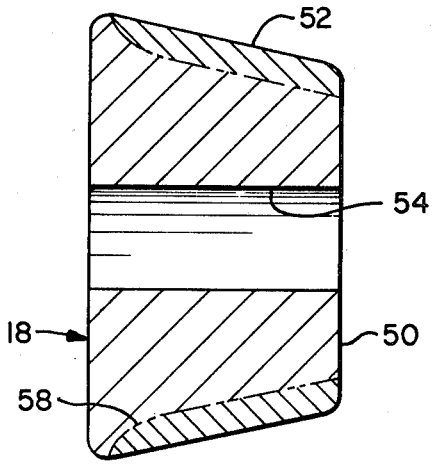
FIG. 4 is a sectional view on an enlarged scale of a pulverizer roll manufactured in accordance with the method of the present invention, illustrating the application of a hard facing to the external surface of the pulverizer roll.

For purposes of setting forth a detailed description of the method of manufacturing a pulverizer roll 18 in accord with the teachings of the present invention, reference will now be had particularly to FIGS. 2, 3 and 4 of the drawing. Note should be made of the fact that FIG. 2 in contrast to FIGS. 3 and 4 is intended simply to provide a general illustration of the nature of the construction which a pulverizer, i.e., grinding, roll 18 manufactured by the method of the present invention embodies. FIGS. 3 and 4, on the other hand, as will be more fully set forth hereinafter, each illustrate with more particularity the nature of the construction of the grinding roll 18. With this frame of reference in mind, it can be seen from FIG. 2 that the grinding roll 18 consists of a main body portion, generally designated by reference numeral 50, that embodies the overall configuration of a roll, and a layered external surface 52 formed of a different material than that from which the body portion 50 is formed. To this end, the body portion 50 is preferably made of a relatively soft, easily machinable material such as gray iron, while the external surface 52 is made of a relatively hard material which has good wear-resistant qualities, i.e., exhibits good abrasion-resistant characteristics. Further, as best understood with reference to FIG. 2, the body portion 50 has a through passage 54 formed through substantially the center thereof. The through passage 54 is suitably dimensioned so as to be capable of receiving therewithin in assembled relation thereto the shaft (not shown) to which reference has been previously made hereinbefore, and on which the grinding roll 18 is suitably supported so as to be capable of functioning in the manner described above and shown in FIG. 1.

In essence, the reasons for manufacturing the grinding roll 18 from two dissimilar materials is to give equal recognition to first the fact that there is a need to provide the body portion 50 with the through passage 54 and secondly to the fact that the external surface 52 is subjected to a harsh abrasive action in the course of effecting the pulverization of coal. The result, therefore, is that on the one hand it is desirable that the body portion 50 be made of a relatively soft, easily machinable material so as to facilitate the formation therein of the through passage 54. In contradistinction to this, there is a need for at least the external portion, i.e., that encompassed by the external surface 52, to be made of a relatively hard material characterized by its capability to resist wear, and in particular the wear caused by abrasive action.

For purposes of the illustrations that comprise FIGS. 2, 3 and 4 of the drawing, FIG. 2 as was noted above is intended to simply illustrate in general the nature of the construction of the grinding roll 18. FIG. 3 on the other hand is intended to depict a grinding roll 18 manufactured in accordance with one form of the method of the present invention wherein the external surface 52 consists of a layer of a suitable weld metal that has been suitably applied to the outer surface of the body portion 50. An attempt has been made in FIG. 3 to illustrate the fact that there exists an area, denoted by reference numeral 56 in FIG. 3, of the grinding roll 18 wherein the material located thereat represents a fused composite of the weld metal that constitutes the external surface 52 and of the material of the body portion 50. Further, in accordance with the teachings of the method of the present invention, the outer surface denoted by reference numeral 58 in FIG. 3 of the body portion 50 is provided with a specific configuration that is intended to replicate the external contour of a worn pulverizer roll. The significance of the shaping of the outer surface 58 of the body portion 50 and the manner in which the specific shape with which the body portion 50 is provided is arrived at are both discussed more fully hereinafter. Otherwise, it can be seen from a comparison of FIGS. 2 and 3 that the grinding roll 18 depicted in both of these Figures consists of a body portion 50, the latter having a through passage 54 formed substantially at the center thereof, and an external surface 52, and with dissimilar materials being employed to form each of the components denoted by the body portion 50 and the external surface 52, respectively.

Insofar as FIG. 4 is concerned, the pulverizer roll 18 that is depicted therein embodies essentially the same form of construction as the grinding roll 18 shown in FIG. 3, with but one difference. Namely, rather than the external surface of the grinding roll 18 of FIG. 4 being in the form of a layer of weld metal as in the case of external surface 52 of the grinding roll 18 of FIG. 3, in accord with another form of the method of the present invention the external surface 52 of the roll 18 of FIG. 4 consists of a layer of suitably applied hard facing. Other than this difference, the grinding rolls 18 of FIG. 3 and FIG. 4. respectively, are identical in construction, and each bears the same relationship to the grinding roll 18 of FIG. 2 as that which has been set forth above in connection with the discussion of the comparison between the grinding roll 18 of FIG. 3 and that of FIG. 2. Therefore, it is not deemed necessary to reiterate at this point this discussion of the relationships between the showings of grinding rolls 18 that appear in each of the FIGS. 2, 3 and 4 of the drawing. Rather, it is deemed sufficient for purposes of obtaining an adequate understanding of the method of manufacturing a pulverizer roll in accord with the present invention to simply note that the grinding roll 18 of FIG. 4 like that of FIG. 3 includes a body portion 50 having a through passage 54 formed at the center thereof and also having the outer surface 58 thereof shaped in a specific manner, an external surface 52, and with the body portion 50 and the external surface 52 each being formed of a dissimilar material.

With the proceeding discussion serving as a proper background for an understanding of the invention, in accordance with the present invention there is provided a method of manufacturing a pulverizer roll that consists of the following steps. First, a body having the general configuration of a roll is suitably formed from a material that is relatively soft and easily machinable. In accord with the best mode embodiment of the invention the body is formed of gray iron. The process employed for purposes of forming the body so that the latter embodies the configuration of a roll may be that of casting.

Secondly, a suitably dimensioned through passage is formed through substantially the center of the body. This through passage may be formed either during the casting of the body, or else the through passage may be formed by machining out the center of the body. Thirdly, the outer surface of the body is shaped so that the body embodies an outer surface that replicates the external surface of a worn pulverizer roll. For this purpose, the outer surface of the body is shaped in accordance with the predicted wear characteristics that it is anticipated that the roll will experience based on the use to which it is intended to put the roll. The actual shaping of the outer surface of the body may be done either at the time the body is being cast, or by a subsequent machining of the body's outer surface to the desired contour. Lastly, a layer of substantially uniform thickness of a suitable hard surface material is affixed to the outer surface of the body. This layer may take the form of either a layer of weld material applied to the body's outer surface, or a layer in the form of a hard facing applied to the body's outer surface.

Accordingly, it should now be readily apparent from the above that in accordance with the present invention a method is provided for manufacturing a pulverizer roll that embodies many advantageous features. First, the pulverizer roll produced by the method of the present invention embodies a body portion that comprises most of the structure of the grinding roll. This body portion is capable of being made from a material that is relatively easy to work thereby enabling economies of manufacture to be realized from the use of this material for this purpose. Secondly, the pulverizer roll produced by the method of the present invention embodies an external surface that consists of a relatively hard material that is capable of resisting abrasion. Therefore, this pulverizer roll is capable of performing its intended function of accomplishing the pulverization of material such as coal in an effective and efficient manner. Thirdly, the pulverizer roll produced by the method of the present invention is advantageously characterized in the fact that as a newly manufactured roll it is capable of providing a longer operating life before it becomes unusable by virtue of having become worn, than can a new pulverizer roll that has been manufactured by means of heretofore known prior art methods. This longer operating life for the pulverizer roll manufactured by the method of the present invention is obtainable by virtue of the fact that the outer surface of the body portion of the pulverizer roll is shaped so as to embody a particular configuration, before a layer of substantially uniform thickness of a relatively hard material is applied to the outer surface of the body portion. The configuration with which the outer surface of the body portion is provided replicates that of the external contour of a worn pulverizer roll. In this regard, it is possible from empirical data derived from extensive experience gained from the prior operation of multitudes of bowl mills to predict the wear characteristics that a pulverizer roll that is to be put to use in a given application will exhibit. Moreover, in accord with the present invention, it has been found that if the outer surface of the body portion of the pulverizer roll is made to embody a contour that replicates the external surface of a worn pulverizer roll, and if a substantially uniform layer of hard material is then applied to the outer surface of the body portion, the pulverizer roll produced in this manner exhibits a longer operating life than a new pulverizer roll manufactured in accordance with the methods taught by the prior art.

Namely, a pulverizer roll produced in accordance with the method of the present invention obviates the disadvantages associated with providing a hard surface to the outer surface of a new pulverizer roll wherein the outer surface of the latter does not replicate the external contour of a worn pulverizer roll. That is, newly manufactured pulverized rolls provided with a hard surface have heretofore been disadvantageously characterized in the fact that there occured uneven wear of the external surface of the pulverizer roll. As a consequence, the hard material with which the external surface of such pulverizer rolls manufactured by prior art methods have been provided has exhibited a susceptibility to incur uneven wear which has caused the hard material to demonstrate substantial wear at various points, while other portions of the hard material have remained usable. However, the fact that some portions of the hard material have incurred substantial wear renders the entire pulverizer roll unusable, i.e., necessitates the replacement of the pulverizer roll by virtue of the fact that the latter has become worn. In contradistinction thereto, the pulverizer roll manufactured in accordance with the present invention is characterized by the fact that the roll exhibits a tendency to experience a more uniform rate of wear. This results from the fact that the pattern of wear which the external surface of the roll will experience has already been replicated in the shaping of the outer surface of the body portion to which the hard surface is applied. Consequently, all points on the circumference of the pulverizer roll manufactured in accord with the method of the present invention wear more uniformly. That is, the uneven wear heretofore occasioned in the case of pulverizer rolls manufactured by prior art methods is obviated in the case of pulverizer rolls manufactured in accord with the method of the present invention by virtue of the fact that the outer surface of the body portion of the latter embodies no areas that are susceptible to wearing away to a greater extent than any other areas thereof. Summarizing the preceding, because of the shaping of the outer surface of the body portion of the latter roll which takes place in the course of the manufacture thereof in accord with the teachings of the method of the present invention, a pulverizer roll is provided which is characterized by its extended operating life vis-a-vis that obtainable heretofore from a pulverizer roll produced by prior art methods of manufacture.

Thus, in accordance with the present invention there has been provided a new and improved method of manufacturing a pulverizer roll. Moreover, the method of the present invention enables a pulverizer roll to be manufactured in accord therewith wherein the roll is suitable primarily for embodiment in a bowl mill for use therein to effect the pulverization of a material such as coal. In addition, in accord with the present invention a method is provided wherein the pulverizer roll manufactured in accord therewith is characterized by its relatively long operating life. Further, the method of the present invention enables a pulverizer roll to be manufactured in accord therewith wherein a roll achieves its relatively long operating life by virtue of having a hard facing applied in a novel manner to the external surface of the pulverizer roll. Additionally, in accordance with the present invention a method is provided wherein the pulverizer roll manufactured in accord therewith achieves its relatively long operating life by virtue of having a layer of weld metal applied in a novel manner to the external surface of the pulverizer roll. Also, the method of the present invention enables a pulverizer roll to be manufactured in accord therewith wherein the roll is characterized by the fact that the external surface thereof is shaped in accordance with the predicted wear characteristics that the pulverizer roll is expected to experience based on the nature of the use to which the pulverizer roll is intended to be put such that the contour thereof replicates that of a worn pulverizer roll. Furthermore, in accord with the present invention a method is provided which is relatively easy to employ, and which enables economies in manufacture to be realized through the use thereof.

While only one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all the other modifications which fall within the true spirit and scope of my invention.

What is claimed is:

1. In a method of manufacturing a pulverizer roll of the type suitable for use in a bowl mill comprising the steps of forming a body having the overall configuration of a roll and providing a through passage through substantially the center of the body, the improvement comprising the steps of predicting the wear characteristics that the pulverizer roll is expected to experience based on the nature of the use to which the pulverizer roll is intended to be put, forming the outer surface of the body so that the contour thereof is a replication of the outer surface of a body that has actually experienced these predicted wear characteristics, and applying a layer of a hard material characterized by its wear-resistant qualities to the outer surface of the body.

2. In a method of manufacturing a pulverizer roll, the improvement comprising the step of predicting the wear characteristics that the pulverizer roll will experience as set forth in claim 1 wherein the prediction of wear characteristics is based on emperical data derived from extensive actual experience gained from the operation of multitudes of pulverizer rolls.

3. In a method of manufacturing a pulverizer roll, the improvement comprising the step of forming the outer surface of the body as set forth in claim 2 wherein the forming of the outer surface of the body is effected by a casting process.

4. In a method of manufacturing a pulverizer roll, the improvement comprising the step of applying a layer of a hard material as set forth in claim 3 wherein the layer of hard material applied to the outer surface of the body comprises a layer of weld material.

5. In a method of manufacturing a pulverizer roll, the improvement comprising the step of applying a layer of a hard material as set forth in claim 3 wherein the layer of hard material applied to the outer surface of the body comprises a hard facing.

6. In a method of manufacturing a pulverizer roll, the improvement comprising the step of forming the outer surface of the body as set forth in claim 2 wherein the forming of the outer surface of the body is effected by means of a machining process.

7. In a method of manufacturing a pulverizer roll, the improvement comprising the step of applying a layer of a hard material as set forth in claim 6 wherein the layer of hard material applied to the outer surface of the body comprises a layer of weld material.

8. In a method of manufacturing a pulverizer roll, the improvement comprising the step of applying a layer of a hard material as set forth in claim 6 wherein the layer of hard material applied to the outer surface of the body comprises a hard facing.

* * * * *